US007608769B2

(12) United States Patent
Izen et al.

(10) Patent No.: US 7,608,769 B2
(45) Date of Patent: Oct. 27, 2009

(54) PACKAGED DRUM SET

(75) Inventors: Mark S. Izen, Chestnut Hill, MA (US); Alexander Webb, Wayland, MA (US); Brian Archer, Carver, MA (US); Michael Oppenheim, Abington, MA (US); Gerard Helfrich, Somerville, MA (US)

(73) Assignee: First Act, Inc., Boston, MA (US)

( * ) Notice: Subject to any disclaimer, the term of this patent is extended or adjusted under 35 U.S.C. 154(b) by 979 days.

(21) Appl. No.: 10/842,764

(22) Filed: May 12, 2004

(65) Prior Publication Data

US 2005/0252358 A1 Nov. 17, 2005

(51) Int. Cl.
*G10D 13/02* (2006.01)

(52) U.S. Cl. ..... 84/411 R

(58) Field of Classification Search ..... 84/411, 84/411 R, 422.1, 422.2, 422.3; 229/103.3, 229/120.02, 162.6, 116.1, 422.1, 422.2, 422.3
See application file for complete search history.

(56) References Cited

U.S. PATENT DOCUMENTS

| | | | | |
|---|---|---|---|---|
| 1,725,073 | A * | 8/1929 | Hacker | 229/116.1 |
| 3,747,464 | A * | 7/1973 | Russell | 84/422.1 |
| 4,927,008 | A * | 5/1990 | Platt | 229/120.02 |
| 5,934,551 | A * | 8/1999 | Kaufman | 229/162.6 |

* cited by examiner

*Primary Examiner*—Kimberly R Lockett
(74) *Attorney, Agent, or Firm*—Townsend and Townsend and Crew LLP

(57) ABSTRACT

A packaged drum set including a carton having a top wall, a bottom wall, and a plurality of side walls one of which defines a transparent window; and wherein the walls form a chamber retaining a frame assembly which defines a first nest disposed in a lower portion of the chamber and second and third horizontally spaced apart nests disposed in an upper portion of the chamber. At least partially visible through the window are a bass drum disposed in the first nest; a snare drum disposed in the second nest; and a tom drum disposed in the third nest. The window provides a clear impression of the drum set retained within the carton.

20 Claims, 5 Drawing Sheets

PACKAGED DRUM SET

BACKGROUND OF THE INVENTION

This invention relates generally to a packaged drum set and, more particularly, to a substantially fully assembled packaged drum set.

Individual drums typically are obtained by either ultimate users or retail establishments in disassembled form within a shipping carton. Consequently, a user is faced with the often daunting and tedious project of completing assembly before a drum can be played. This problem is accentuated, obviously, when a complete drum set requires assembly prior to usage.

The object of the invention, therefore, is to provide a packaged drum set which simplifies assembly and increases the desire of potential purchasers to acquire and subsequently use the drum set.

SUMMARY OF THE INVENTION

The invention is a packaged drum set including a carton having a top wall, a bottom wall, and a plurality of side walls one of which defines a transparent window; and wherein the walls form a chamber retaining a frame assembly which defines a first nest disposed in a lower portion of the chamber and second and third horizontally spaced apart nests disposed in an upper portion of the chamber. At least partially visible through the window are a bass drum disposed in the first nest; a snare drum disposed in the second nest; and a tom drum disposed in the third nest. The window provides a clear impression of the drum set retained within the carton.

According to one feature of the invention, a head portion of the bass drum is visible through the window and shell portions of the snare and tom drums are visible through the window. This feature provides a potential buyer with a visible indication of an assembled version of the drum set retained in the carton.

According to other features of the invention, the snare and tom drums are fully assembled, the carton retains drum set stand hardware, at least some of which is mounted on the drums and visible through the window, and tension rods are mounted on the snare and tom drums and also are visible through the window. These features provide clear impressions that a complete, nearly fully assembled drum set is retained within the carton.

According to yet another feature of the invention, the carton retains a cymbal disposed in a fourth nest located above the tom drum and a seat disposed in a fifth nest located above the snare drum. The cymbal and seat complete the drum set and their positioning in the fourth and fifth nests improves compactness.

According to still another feature of the invention, a pictorial display of a player seated at a complete drum set is applied to the one side wall adjacent to the window. The display further enhances an appreciation of the cartons content.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
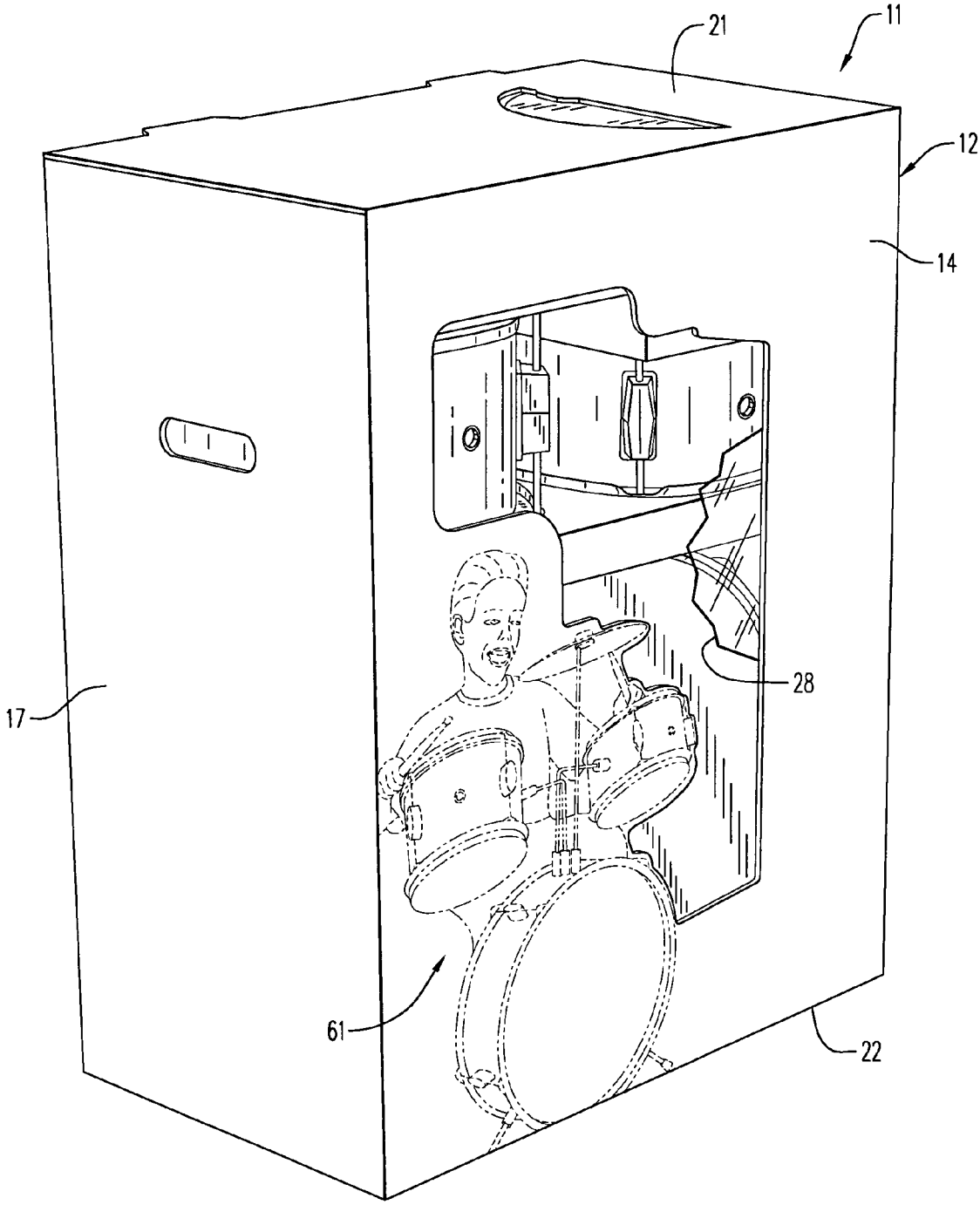
FIG. 1 is a perspective view of a packaged drum set according to the invention.
Figure 2:
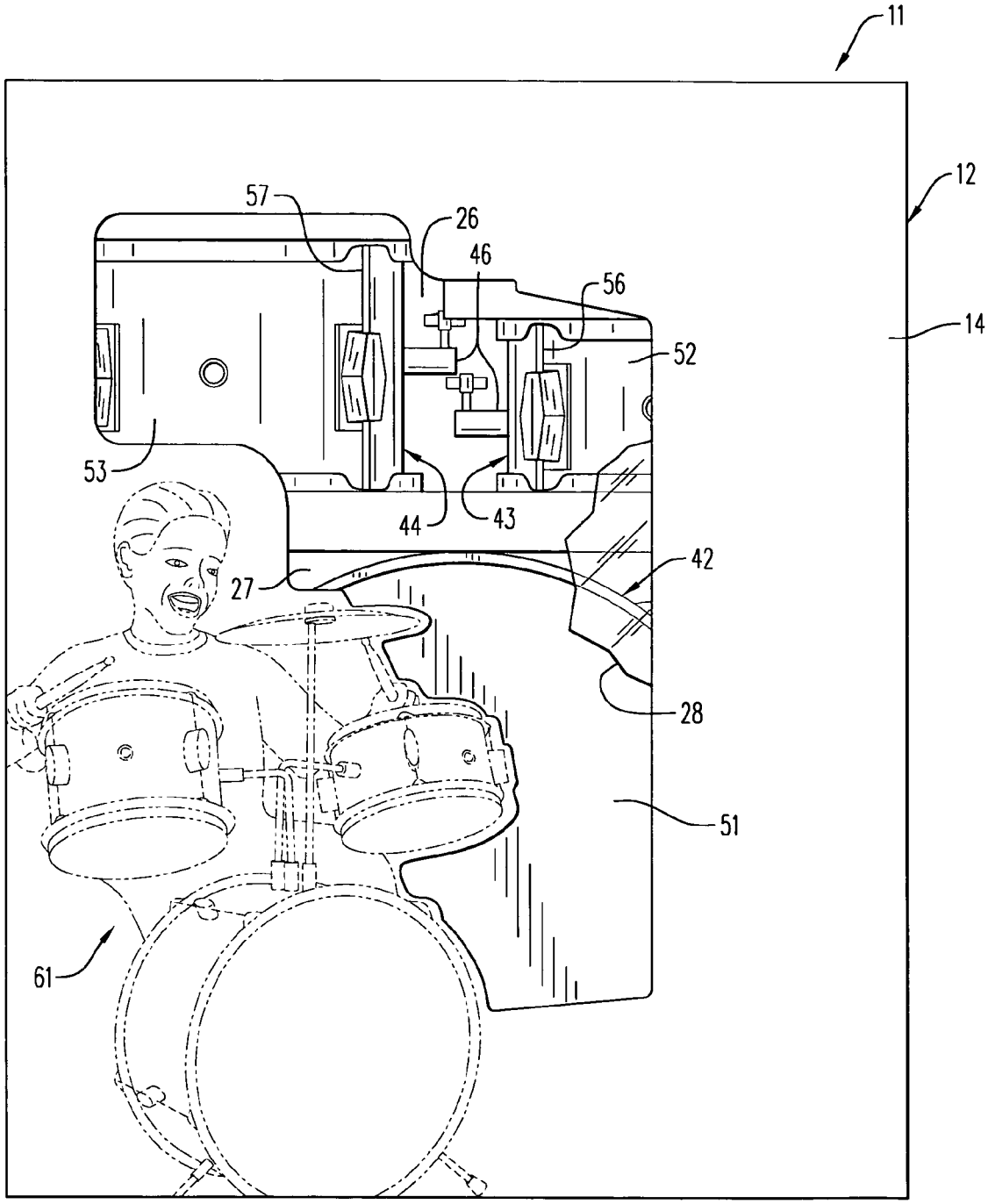
FIG. 2 is a front view of the packaged drum set shown in FIG. 1.
Figure 3:
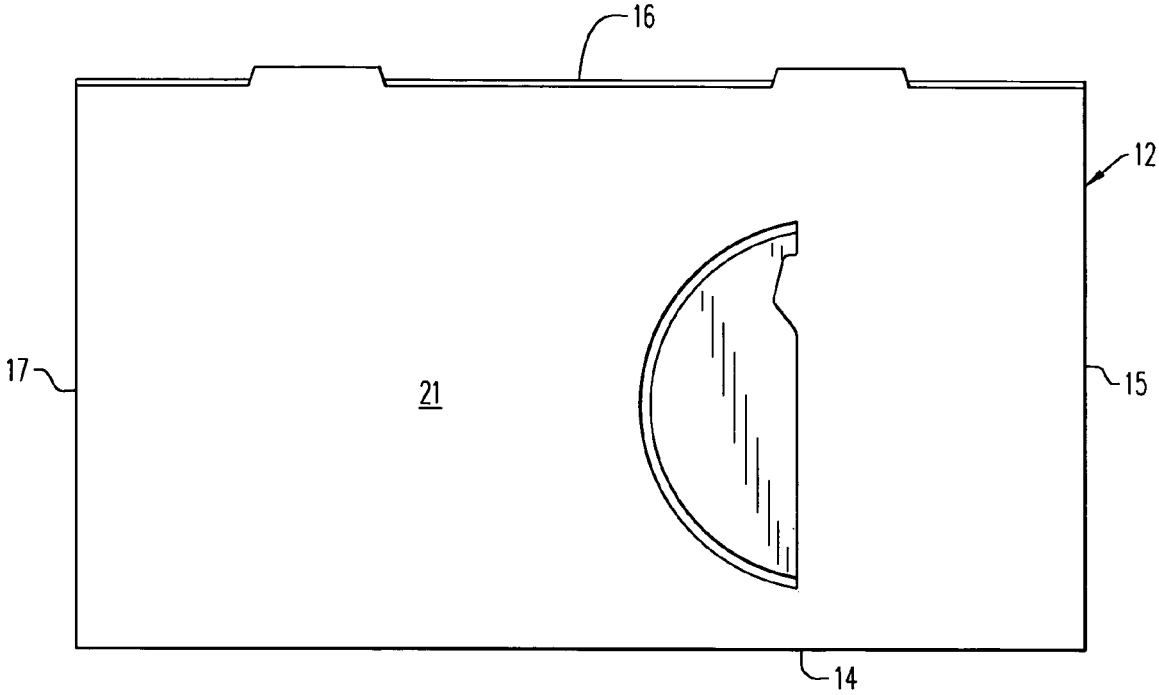
FIG. 3 is a top view of the packaged drum set shown in FIG. 1.
Figure 4:
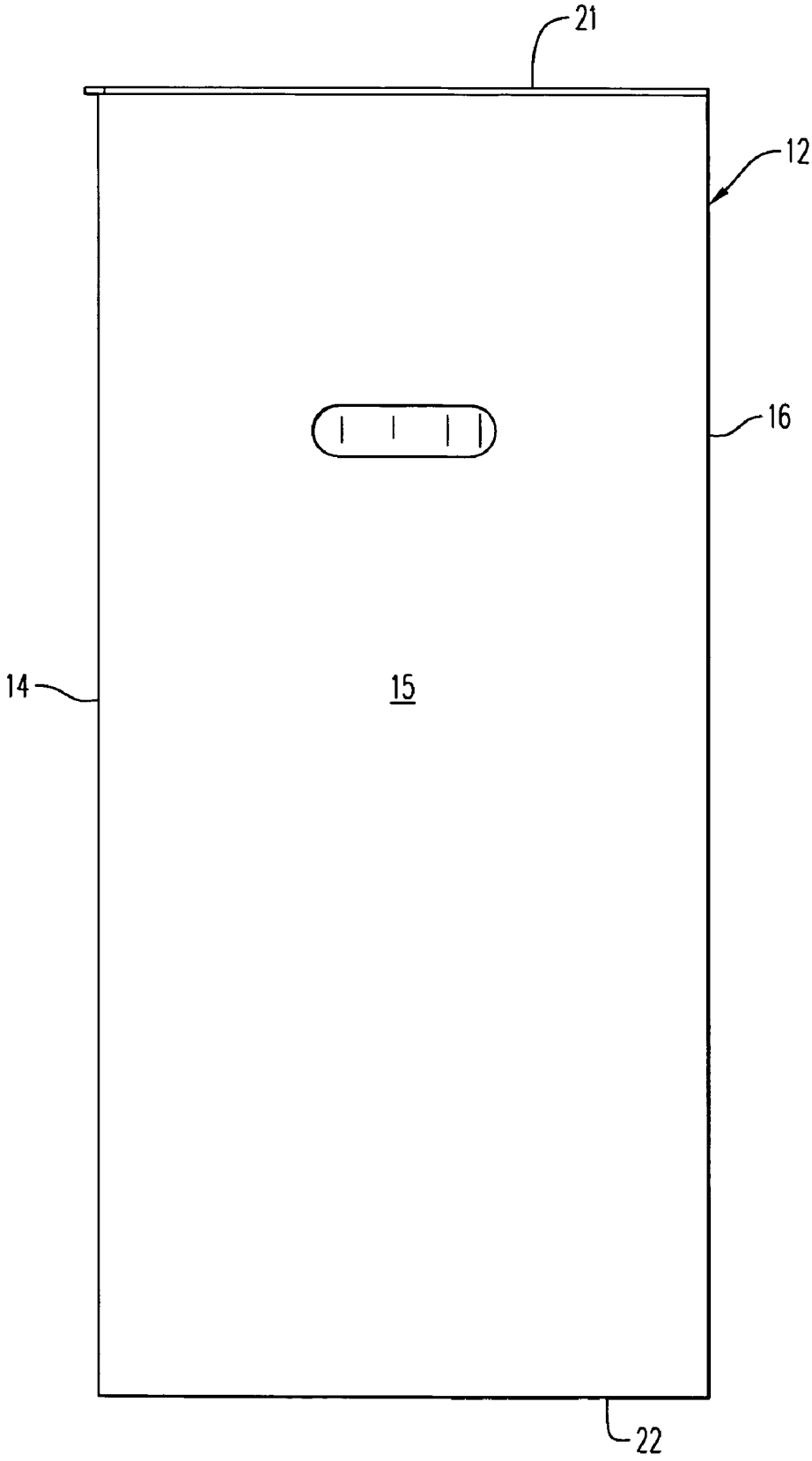
FIG. 4 is a right side view of the packaged drum set shown in FIG. 1.

A packaged drum set 11 shown in FIGS. 1 and 2 includes a carton 12 having side walls 14-17 extending between a top wall 21 and a bottom wall 22. Formed by the walls 14-17, 21 and 22 is a chamber including an upper portion 26 and a lower portion 27. One of the side walls 14 defines a transparent window 28 providing visual access to the upper and lower portions 26, 27 of the chamber.

A cardboard frame assembly 31 is retained within the chamber formed by the carton 12. Defined by the frame assembly 31 is a first nest 33 located in the lower chamber portion 27 and horizontally spaced apart second and third nests 34, 35 located in the upper chamber portion 26. A fourth cardboard nest 36 is located above the third nest 35 and a fifth cardboard nest 37 is located above the second nest 34. Support for the fourth and fifth nests 36, 37 is provided as described hereinafter.

Figure 5:
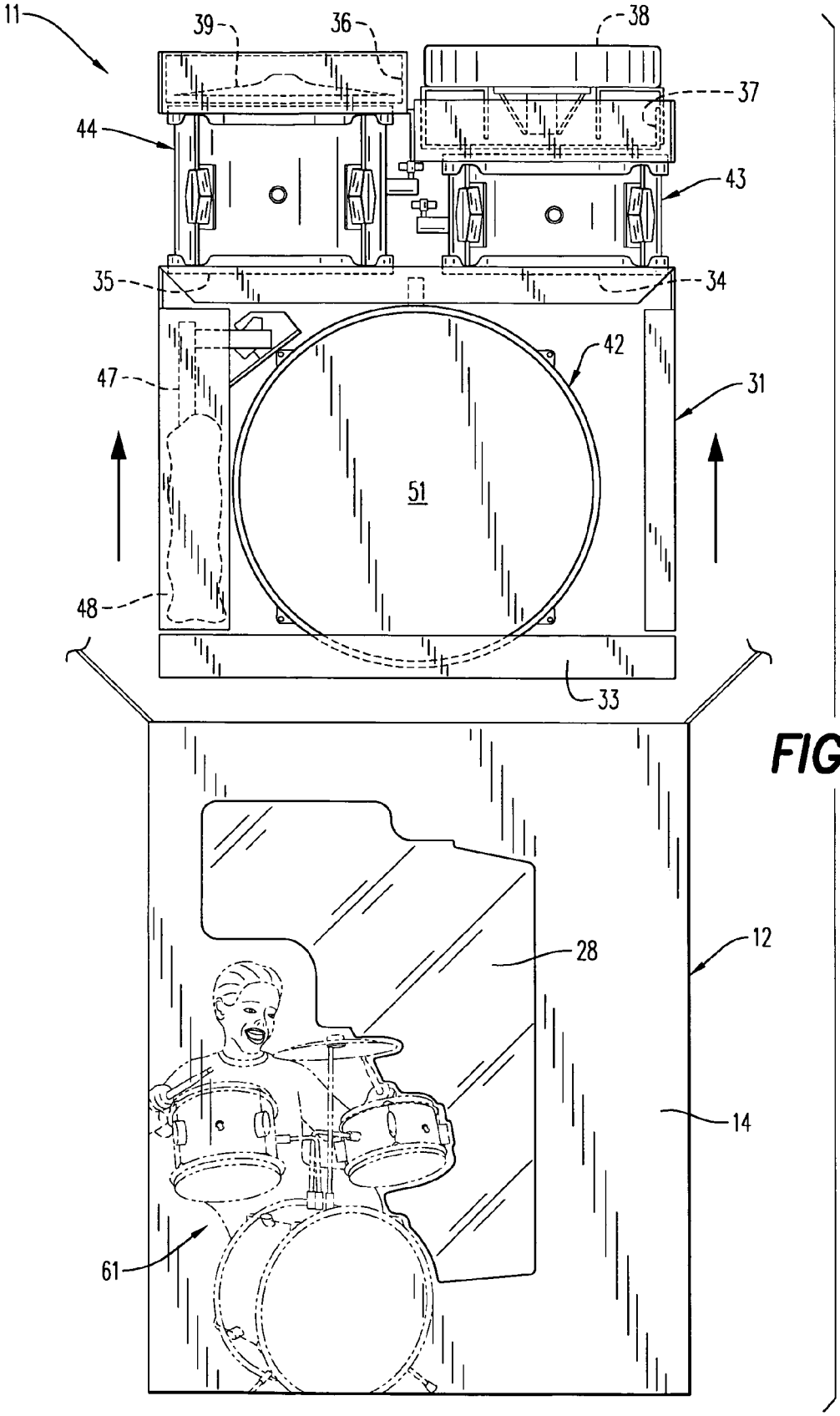
FIG. 5 is an exploded view of the packaged drum set shown in FIG. 1.

As illustrated most clearly in FIG. 5, the complete drum set 11 is supported by the frame assembly 31 within the carton 12. The drum set 11 includes a bass drum 42 disposed in the first nest 33, a snare drum 43 disposed in the second nest 34 and a tom drum 44 disposed on the third nest 35. Also included in the drum set 11 are a cymbal 39 disposed in the fourth nest 36 and supported by the tom drum 44 and a seat 38 disposed in the fifth nest 37 and supported by the snare drum 43. Preferably, the drums 42-44 are fully assembled as shown and include some drum stand hardware 46. Additional drum stand hardware and a foot pedal assembly 47 are retained in a compartment 48 located laterally adjacent to the bass drum 42.

The drums 42-44 are partially visible through the window 28 and lie in relative positions corresponding to their positions as a completed drum set. Accordingly, a head portion 51 of the bass drum 42 and shell portions 52, 53 of the snare and tom drums 43, 44 are visible through the window 28. The full assembly of the drums 42-44 is apparent in that tension rods 56, 57 assembled, respectively, on the drums 43, 44 also are visible. Additionally visible through the window 28 is the stand hardware 46 also assembled to the drums 43, 44. The appearance of an assembled drum set visible through the window 28 is enhanced by the provision on the one side wall 14 adjacent to the window 28 of a pictorial display 61 of a player seated at a fully assembled drum set.

Obviously, many modifications and variations of the present invention are possible in light of the above teaching. It is to be understood, therefore, that the invention can be practiced otherwise than as specifically described.

What is claimed is:

1. A packaged drum set comprising:

a carton having a top wall, a bottom wall, and a plurality of side walls extending between said top and bottom walls to form a chamber; one of said side walls defining a transparent window providing visual access into said chamber;

a frame assembly retained within said chamber and defining a first nest disposed in a lower portion of said chamber and second and third horizontally spaced apart nests disposed in an upper portion of said chamber;

a bass drum disposed in said first nest and at least partially visible through said window;

a snare drum disposed in said second nest and at least partially visible through said window; and a tom drum disposed in said third nest and at least partially visible through said window.

2. A packaged drum set according to claim 1 wherein a head portion of said bass drum is visible through said window, a shell portion of said snare drum is visible through said window, and a shell portion of said tom drum is visible through said window.

3. A packaged drum set according to claim 2 wherein each of said bass, snare and tom drums is fully assembled.

4. A packaged drum set according to claim 3 wherein stand hardware for supporting said bass, snare and tom drums is disposed in said chamber.

5. A packaged drum set according to claim 4 wherein at least some of said hardware is mounted on said drums and visible through said window.

6. A packaged drum set according to claim 5 wherein tension rods mounted on said snare and tom drums are visible through said window.

7. A packaged drum set according to claim 1 wherein a cymbal is disposed in a fourth nest located above said tom drum and a seat is disposed in a fifth nest located above said snare drum.

8. A packaged drum set according to claim 7 wherein a head portion of said bass drum is visible through said window, a shell portion of said snare drum is visible through said window, and a shell portion of said tom drum is visible through said window.

9. A packaged drum set according to claim 8 wherein each of said bass, snare and tom drums is fully assembled.

10. A packaged drum set according to claim 9 wherein stand hardware for supporting said drums, cymbal and seat are disposed in said chamber.

11. A packaged drum set according to claim 10 wherein at least some of said hardware is mounted on said drums and visible through said window.

12. A packaged drum set according to claim 1 wherein a pictorial display of a player seated at an assembled drum set is applied to said one side wall adjacent to said window.

13. A packaged drum set according to claim 12 wherein a head portion of said bass drum is visible through said window, a shell portion of said snare drum is visible through said window, and a shell portion of said tom drum is visible through said window.

14. A packaged drum set according to claim 13 wherein each of said bass, snare and tom drums is fully assembled.

15. A packaged drum set according to claim 12 wherein a cymbal is disposed in a fourth nest located above said tom drum and a seat is disposed in a fifth nest located above said snare drum.

16. A packaged drum set according to claim 15 wherein a head portion of said bass drum is visible through said window, a shell portion of said snare drum is visible through said window, and a shell portion of said tom drum is visible through said window.

17. A packaged drum set according to claim 16 wherein each of said bass, snare and tom drums is fully assembled.

18. A packaged drum set according to claim 17 wherein stand hardware for supporting said drums, cymbal and seat are disposed in said chamber.

19. A packaged drum set according to claim 18 wherein at least some of said hardware is mounted on said drums and visible through said window.

20. A packaged drum set according to claim 19 wherein tension rods mounted on said snare and tom drums are visible through said window.

* * * * *

UNITED STATES PATENT AND TRADEMARK OFFICE

CERTIFICATE OF CORRECTION

PATENT NO. : 7,608,769 B2
APPLICATION NO. : 10/842764
DATED : October 27, 2009
INVENTOR(S) : Izen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1019 days.

Signed and Sealed this

Twelfth Day of October, 2010

David J. Kappos

David J. Kappos
*Director of the United States Patent and Trademark Office*